US006102124A

United States Patent [19]

Skeels et al.

[11] Patent Number: 6,102,124

[45] Date of Patent: Aug. 15, 2000

[54] FLYING LEAD WORKOVER INTERFACE SYSTEM

[75] Inventors: Harold B. Skeels, Kingwood; Timothy R. Goggans, Cypress, both of Tex.; Sterling F. Lewis, Kongsberg, Norway; Robert J. Writt, Houston, Tex.

[73] Assignee: FMC Corporation, Chicago, Ill.

[21] Appl. No.: 09/345,228

[22] Filed: Jun. 30, 1999

Related U.S. Application Data

[60] Provisional application No. 60/091,560, Jul. 2, 1998.

[51] Int. Cl.[7] ..... E21B 43/01

[52] U.S. Cl. ..... 166/347; 166/356; 405/191

[58] Field of Search ..... 405/188, 190, 405/191; 166/338, 339, 340, 347, 356

[56] References Cited

U.S. PATENT DOCUMENTS

| | | | |
|---|---|---|---|
| 3,504,741 | 4/1970 | Baker et al. | 166/356 |
| 3,621,911 | 11/1971 | Baker et al. | 166/356 |
| 5,074,713 | 12/1991 | Reis | 405/191 |
| 5,593,259 | 1/1997 | Cox et al. | 405/191 |
| 5,730,551 | 3/1998 | Skeels et al. | 166/347 |

*Primary Examiner*—William Neuder

*Attorney, Agent, or Firm*—Gary L. Bush; Mayor, Day, Caldwell & Keeton LLP

[57] ABSTRACT

Flying lead hydraulic and electrical umbilical arrangements are disclosed for control of a subsea christmas tree for production and workover operations. Alternative arrangements for deep water ROV arrangements for a conventional christmas tree are illustrated in FIGS. 2A, 2B and in FIGS. 3A, 3B, and 3C. Alternative arrangements for a horizontal christmas tree are illustrated in FIGS. 5, 6, and 7.

13 Claims, 14 Drawing Sheets

FLYING LEAD WORKOVER INTERFACE SYSTEM

REFERENCE TO PRIOR APPLICATION

This application claims priority from Provisional Application 60/091,560 filed Jul. 2, 1998.

BACKGROUND OF THE INVENTION

1. Field of the Invention

This invention relates generally to subsea well equipment and methods. In particular the invention relates to apparatus and methods for controlling subsea christmas tree functions during workover operations.

2. Description of the Prior Art

The conventional method of controlling underwater (subsea) tree functions has been through a connection method from a remote hydraulic or electrical/hydraulic source acting via a control or umbilical line and an interface plate(s). These interface plates have been disconnected and reconnected in various ways to switch remote operation from a production (or "host") facility to a vessel overhead during equipment installation and later workover (well intervention). The key to the interfaces is that when in the workover mode, the production mode of operation is locked out, thereby preventing accidental operation by outside sources when critical control of the well is required by the overhead vessel. FIGS. 1A–1D illustrate common practice methods to achieve this crucial requirement.

Prior Shallow Water Arrangements

FIGS. 1A and 1B illustrate that for shallow water depths, disconnect/reconnect operations employ a "stab plate" 2 as part of the shallow water tree 4 as shown in FIG. 1A. The shallow water tree 4 is secured by means of a connector 16 to a wellhead 14 which is secured to the seabed 16. A tree cap 18 closes the top of the tree 4. A conventional stab plate 2 is a junction plate which connects the production hydraulic umbilical 6 from the host remote production platform/production tree 8 to the shallow water tree 4. In other words, hydraulic power is directed to each of the valve actuators 10 of the shallow water tree 4 via the hydraulic lines of the hydraulic umbilical 6 via the conventional stab plate 2 connection.

When workover operations are required, as FIG. 1B illustrates, the production hydraulic umbilical 6 is removed (e.g., by a diver) and parked at a seabed parking plate 12. The shallow water tree cap 18 is removed, parked on the seabed 16, and a workover vessel 20 with a riser 22 and workover equipment is attached to the top of the shallow water tree 4. A workover production umbilical 24 is plugged into the hydraulic line receptacle 26 of the stab plate 2. The vessel 20 assumes control of the hydraulic actuators 10 of the shallow water tree 4.

Prior Deep Water Arrangements

FIGS. 1C and 1D illustrate prior art transfer of control from a platform/production tree 80 to a workover vessel 200 for workover operations. A wellhead 140 and tree master block 40 extend from seabed 16. FIG. 1C illustrates that a tree control pod 30 is placed adjacent a tree manifold 42 which is placed above the tree master valve block 40. A hydraulic production umbilical 6' is connected between the tree control pod 30 and the platform/production tree 80. Control over the flow of each hydraulic line of umbilical 6' is by means of an electrical control system in the tree control pod 30. Control signals are transmitted from host platform/production tree 80 via electrical umbilical 62. Each hydraulic line is connected in the tree manifold 42 by means of "U-loop" lines 46 in the tree cap 180.

FIG. 1D illustrates a prior art or "conventional" deep water workover operation. The tree cap 180 of FIG. 1C is removed (with its "U loop" routing paths) from the tree manifold 42, thereby removing all control of valve actuators 100 from the host remote production/platform tree 80. A completion riser tree running tool 44 replaces the tree cap 180. Conventionally, a Lower Marine Riser Package (LMRP) 47 is secured to the top of running tool 44 and an Emergency Disconnect Package (EDP) 48 is secured to the top of the LMRD. A workover umbilical 240 is provided from the workover vessel 200 to the running tool 44. During workover operations, tree valve actuators 100 are controlled directly from the workover vessel 200. In some cases an additional electro-hydraulic control pod 50 on the riser Emergency Disconnect Package 48 is provided for control of hydraulic actuator control paths.

After the well intervention is finished, the tree running tool 44 is removed and the tree cap 180 is replaced as in FIG. 1C. With the tree cap 180 back in place, control over the tree valve actuators 100 is assumed again by the remote host facility 80 (that is, by the platform/production tree 80). In other words, the "U-loops" 46 which communicate with the tree control pod 30 are again in place and provide control paths for hydraulic fluid to all valve actuators 100 of the tree 40.

To date, the "U-loop" tree cap 46 arrangement and method has been acceptable. However, the "U-loop" tree cap arrangement and method requires twice the number of porting connections for every subsea tree function. Ancillary technology functions (e.g., chemical injection, multiple zone completion—"smart well", etc.) are requiring more and more functions through the top of the tree (which requires doubled of the parting connections by the "U-loop" configuration). Packaging constraints, the degradation of reliability (because of the excessive number of ports, check valves, and leak paths) and manufacturing costs associated with assembling and testing the increasing number of lines makes the "U-loop" configuration more and more impractical.

Workover control systems have traditionally been entirely hydraulic, but they have been replaced recently with electro-hydraulic systems as the subsea oil and gas industry has been producing from deeper and deeper water depths. Deep well depths increase the size and cost of hydraulic control lines. Reels for the hydraulic control lines become too large to handle and/or response times to operate the subsea tree become too long.

Identification of Objects of the Invention

A primary object of the invention is to provide a deep water workover interface system which reduces costs associated with the "U-loop" tree caps of prior art deep water vertical production trees.

Another object of the invention is to increase the control functions available in a new workover interface arrangement for a subsea tree.

Another object of the invention is to improve the reliability of a deep water workover interface arrangement by (1) providing a functioning subsea control pod prior to demobilizing the host control, (2) eliminating potential hydraulic leak paths inherent in the current "U-loop" tree cap arrangement and (3) improving hydraulic testing characteristics of the arrangement during FAT/SIT and offshore testing time.

Another object of the invention is to reduce rig time required of current operations by eliminating a drill pipe trip to install the tree cap after workover operations are complete and production operations are to begin again.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

SUMMARY OF THE INVENTION

The objects described above, as well as other advantages and features of the invention are provided with alternative arrangements which replace the prior art "U-loop" plumbing method for deep water wells. A first embodiment provides hydraulic control; an alternative embodiment provides electro-hydraulic control. Both embodiments are operationally manipulated subsea by (Remotely Operated Vehicle) ROV flying leads which accomplish hand-off tasks between production and workover configurations by disconnecting and reconnecting control lines.

The choice between electro-hydraulic control and hydraulic control depends on the offset distance between the subsea tree and the remote host facility, and the complexity and number of functions and monitor sensors which are to be controlled in the subsea well.

DESCRIPTION OF THE INVENTION

Hydraulic Control Embodiment

Figure 1A:
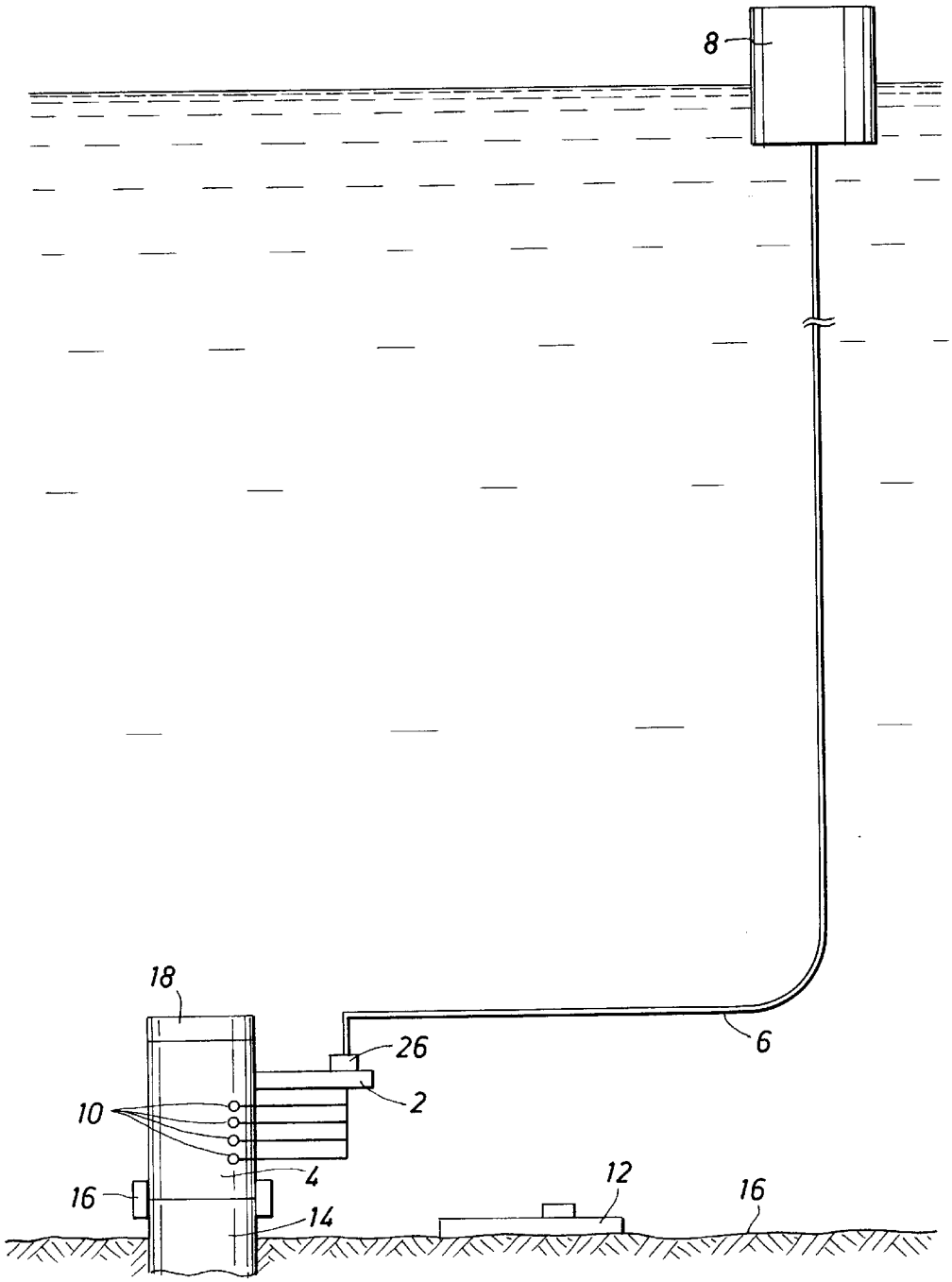
FIG. 1A (PRIOR ART)
FIGS. 1A and 1B illustrate shallow water production and workover arrangements by which a production hydraulic umbilical is disconnected from a stab plate receptacle and is parked prior to workover operations with a workover hydraulic umbilical connected to the stab plate receptacle.
Figure 1B:
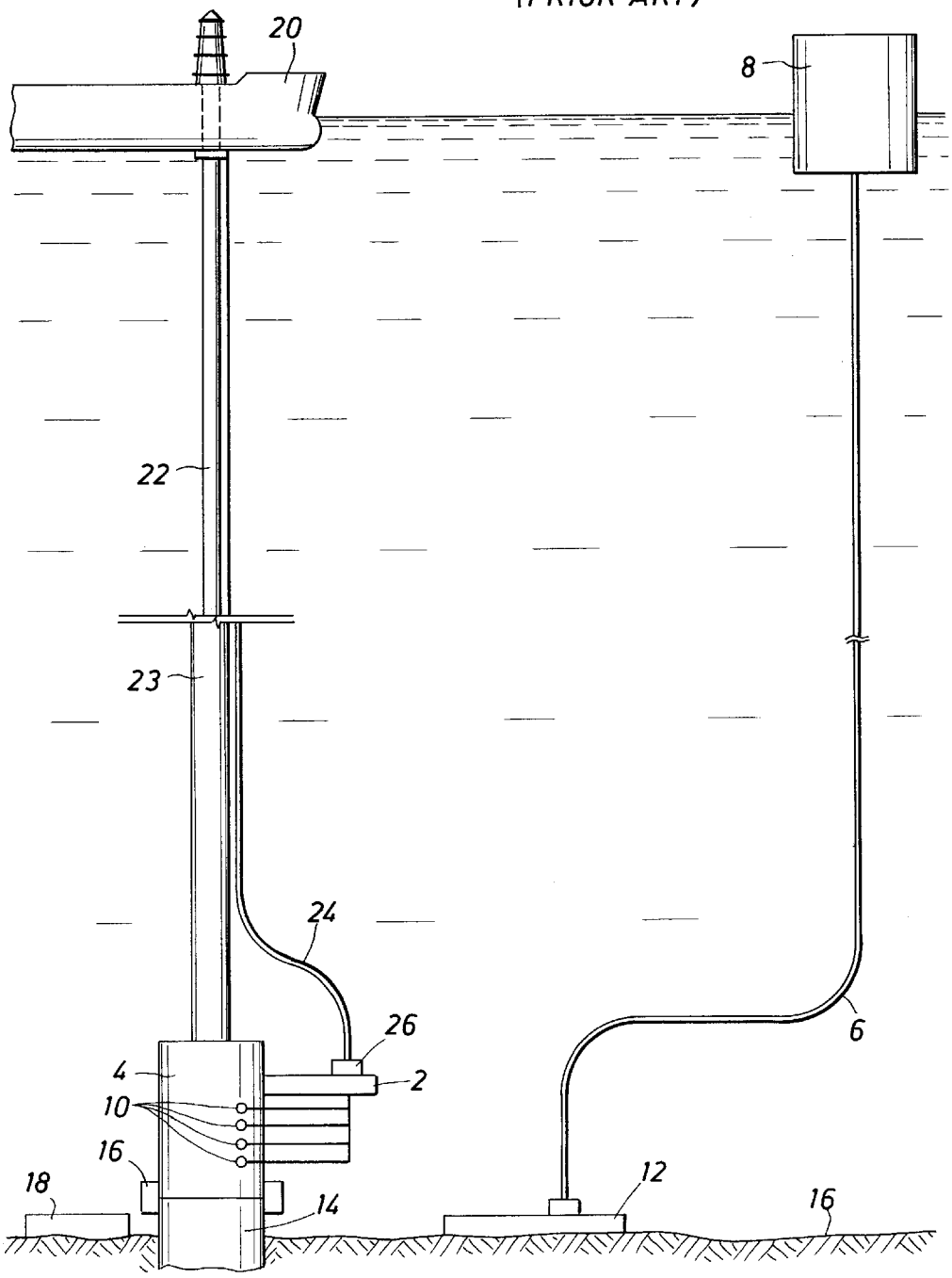
FIG. 1B (PRIOR ART)
Figure 2A:
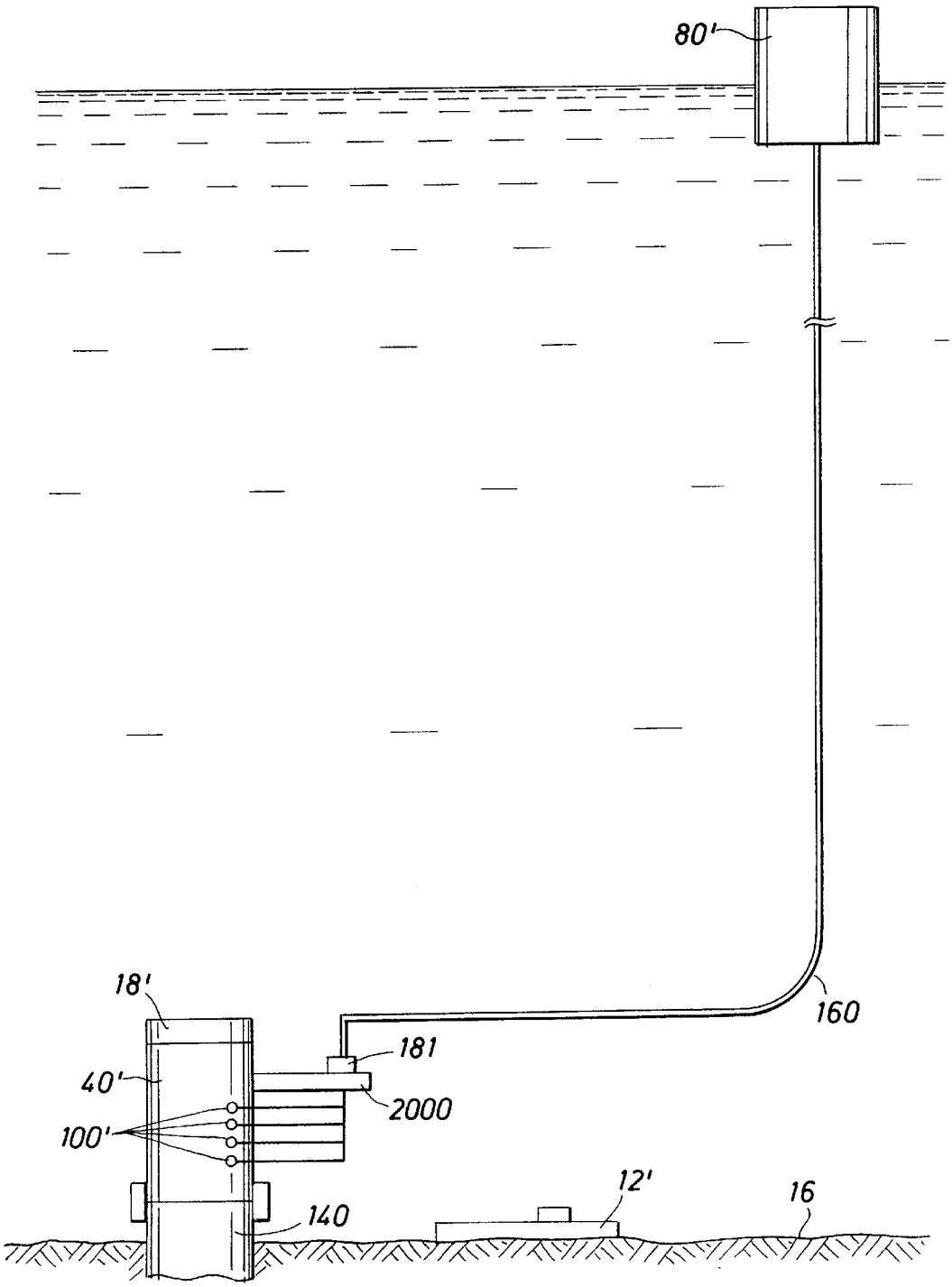
FIGS. 2A and 2B illustrate an entirely hydraulic control embodiment of the invention for deepwater production and workover operations.
Figure 2B:
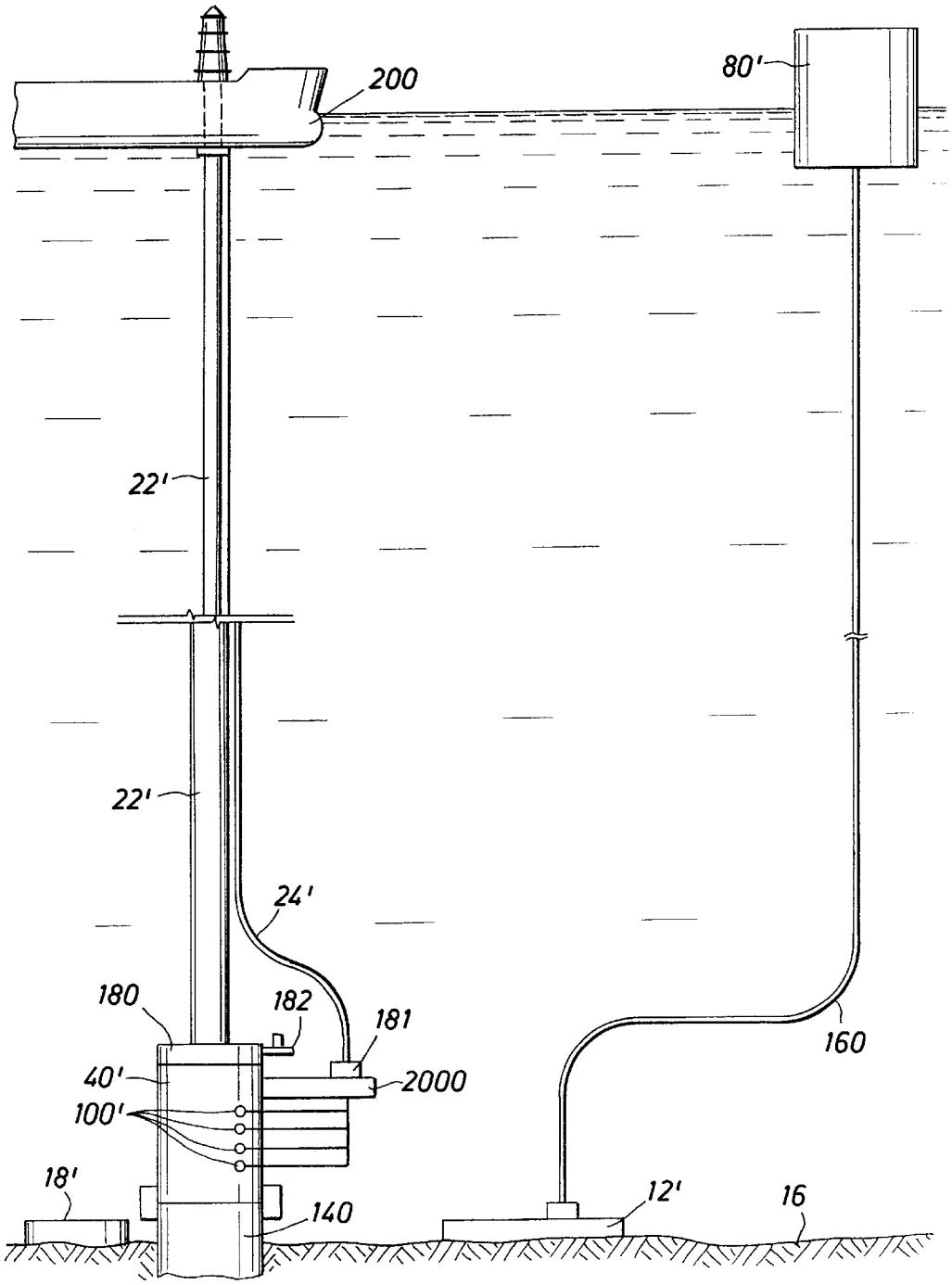

FIGS. 2A and 2B illustrate a hydraulic embodiment of the invention where a subsea tree 40' is equipped for hydraulic control to operate the tree in the production mode. As distinguished from the prior art shallow water embodiment of FIGS. 1A and 1B, the arrangement of FIG. 2A provides a ROV stab plate 2000 coupled to the deep water tree 40'. When workover operations begin, the tree cap 18' is parked on seabed 16, and a riser 22' and an Emergency Disconnect Package 180 are run to the top of tree 40' and secured thereto. The EDP 180 includes a parking plate 182 to which "flying lead" workover hydraulic umbilical is parked during running operations. The coupling 181' at the end of umbilical 24' is "parked" on plate 182. When transfer of control from the production mode of FIG. 2A to the workover mode of FIG. 2B is achieved, the hydraulic supply umbilical 160 is disconnected from the ROV stab plate 2000 by an ROV and is stabbed into a parking plate 12' with the ROV. The flying lead 24' having a stabbing plug 181' at its end, is then stabbed by means of a ROV into stab plate 2000. Hydraulic supply, and control, now is from the workover "flying lead" 24'.

To put the tree back in the production mode, the workover flying lead 24' of FIG. 2B is disconnected from stab plate 2000 of the tree 40' and parked onto parking plate 182 disposed on the riser emergency disconnect package (EDP). The riser 22' is retrieved and the tree cap 18' is reinstalled (See FIG. 2A). The production hydraulic umbilical 160' is moved from the parking plate 12' and is reconnected by means of a ROV to the ROV stab plate 2000. The riser 22' and EDP 180 are removed, and tree cap 18' is reinstalled atop tree 40' to again achieve the production arrangement of FIG. 2A.

Electro-hydraulic Control Embodiment

Figure 1C:
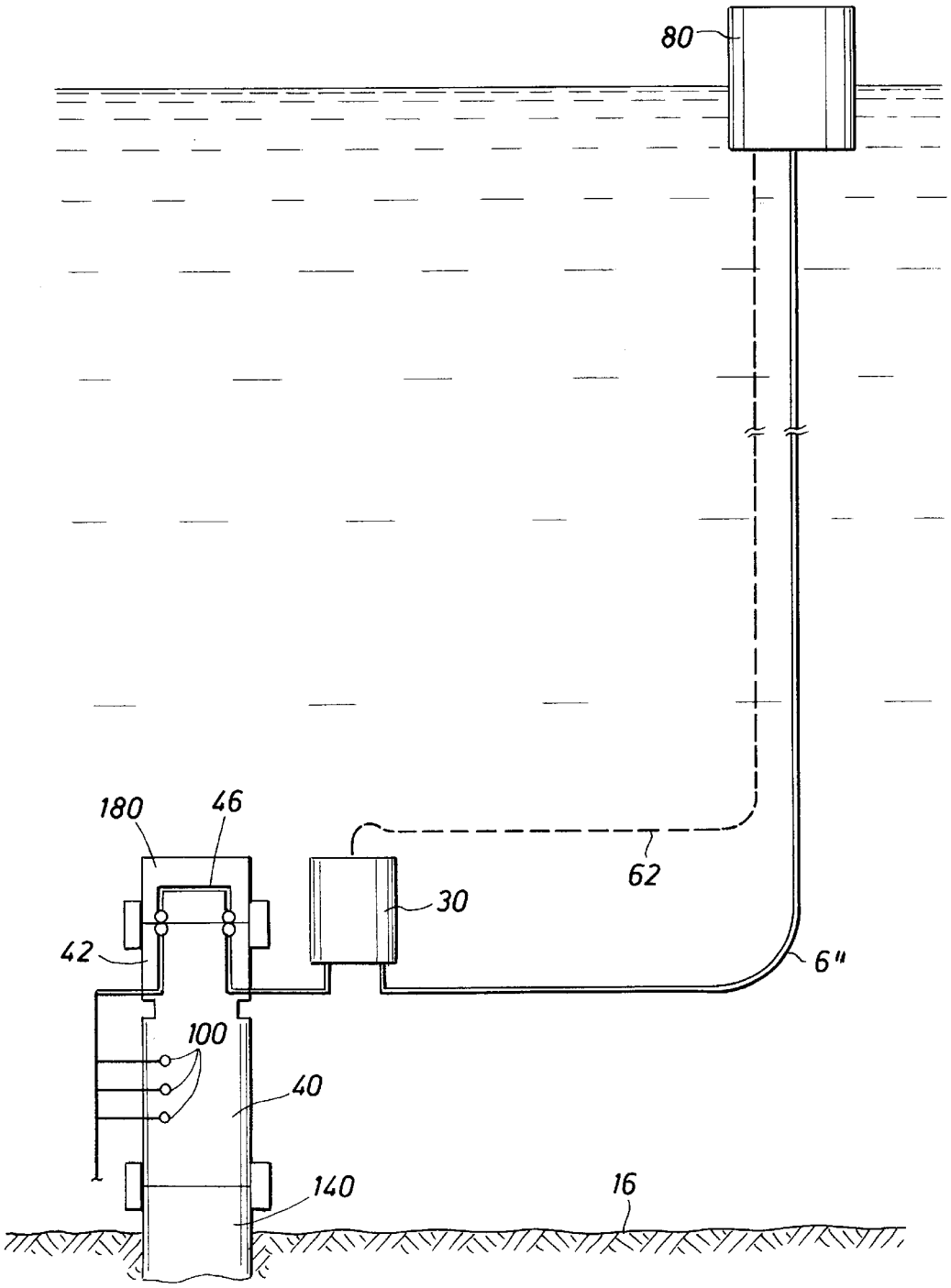
FIG. 1C (PRIOR ART)
FIGS. 1C and 1D illustrate deep water production and workover arrangements where a "U-looped" tree cap provides a flow path for each hydraulic lead from a tree control pod to valve actuators and other devices in the tree and such flow paths are disconnected from the tree control pod by removal of the tree cap and replacement of same with a completion riser running tool which provides flow paths from a workover vessel hydraulic umbilical to valve actuators of the tree.
Figure 1D:
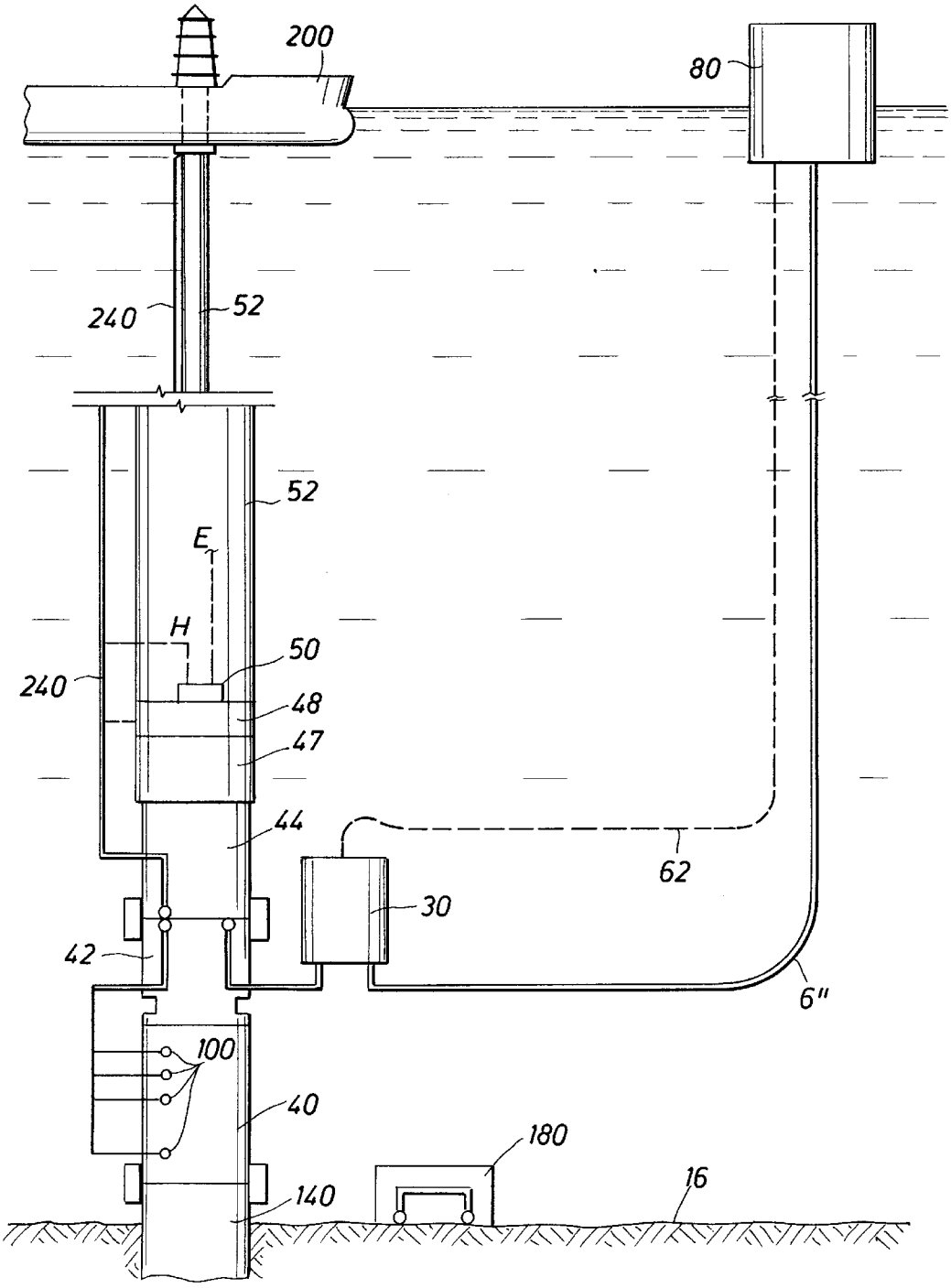
FIG. 1D (PRIOR ART)
Figure 3A:
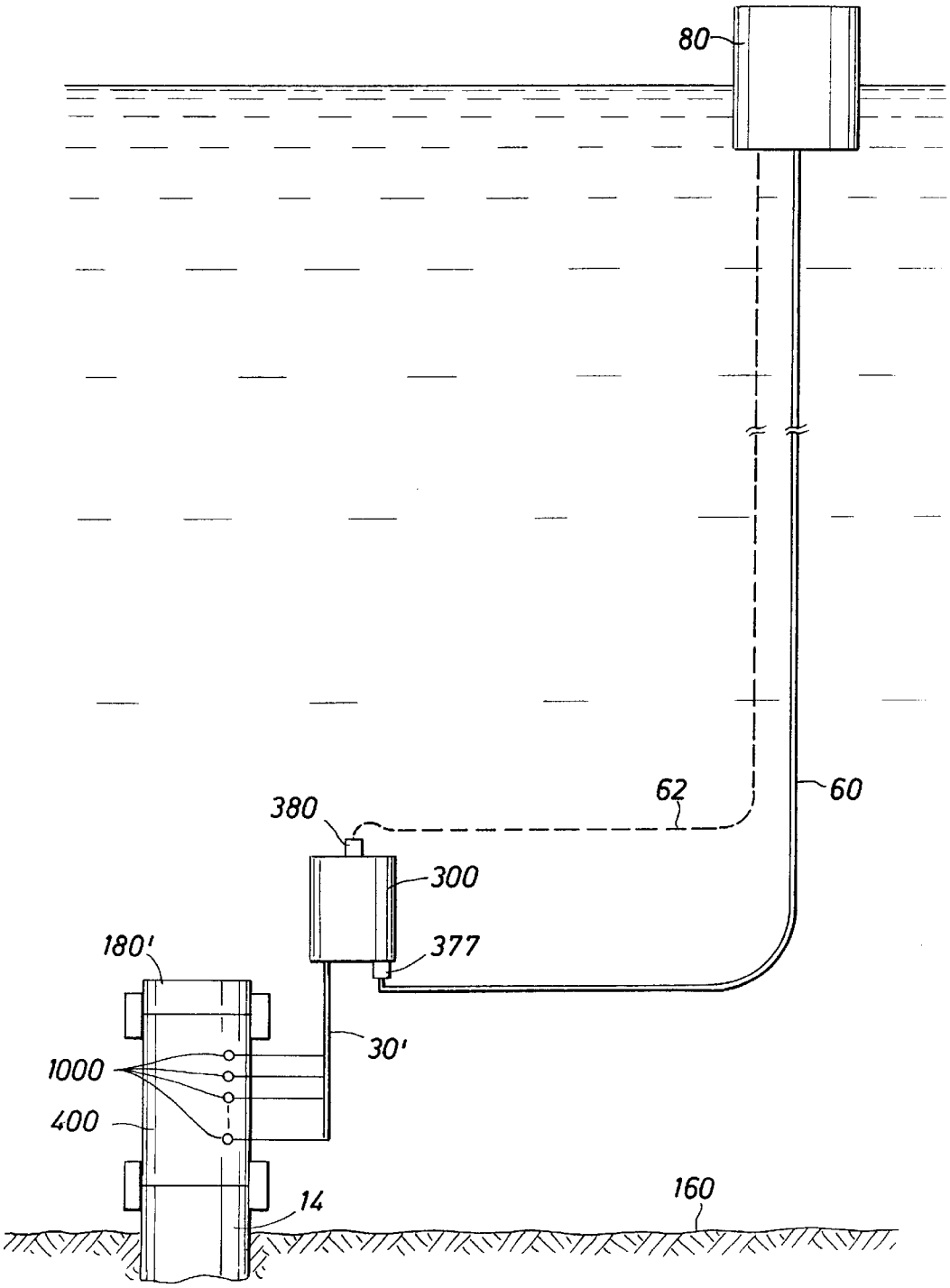
FIGS. 3A, 3B and 3C illustrate an electro-hydraulic control embodiment of the invention for production and workover operations with FIGS. 3B and 3C illustrating alternative "flying lead" arrangements during workover operations.
Figure 3B:
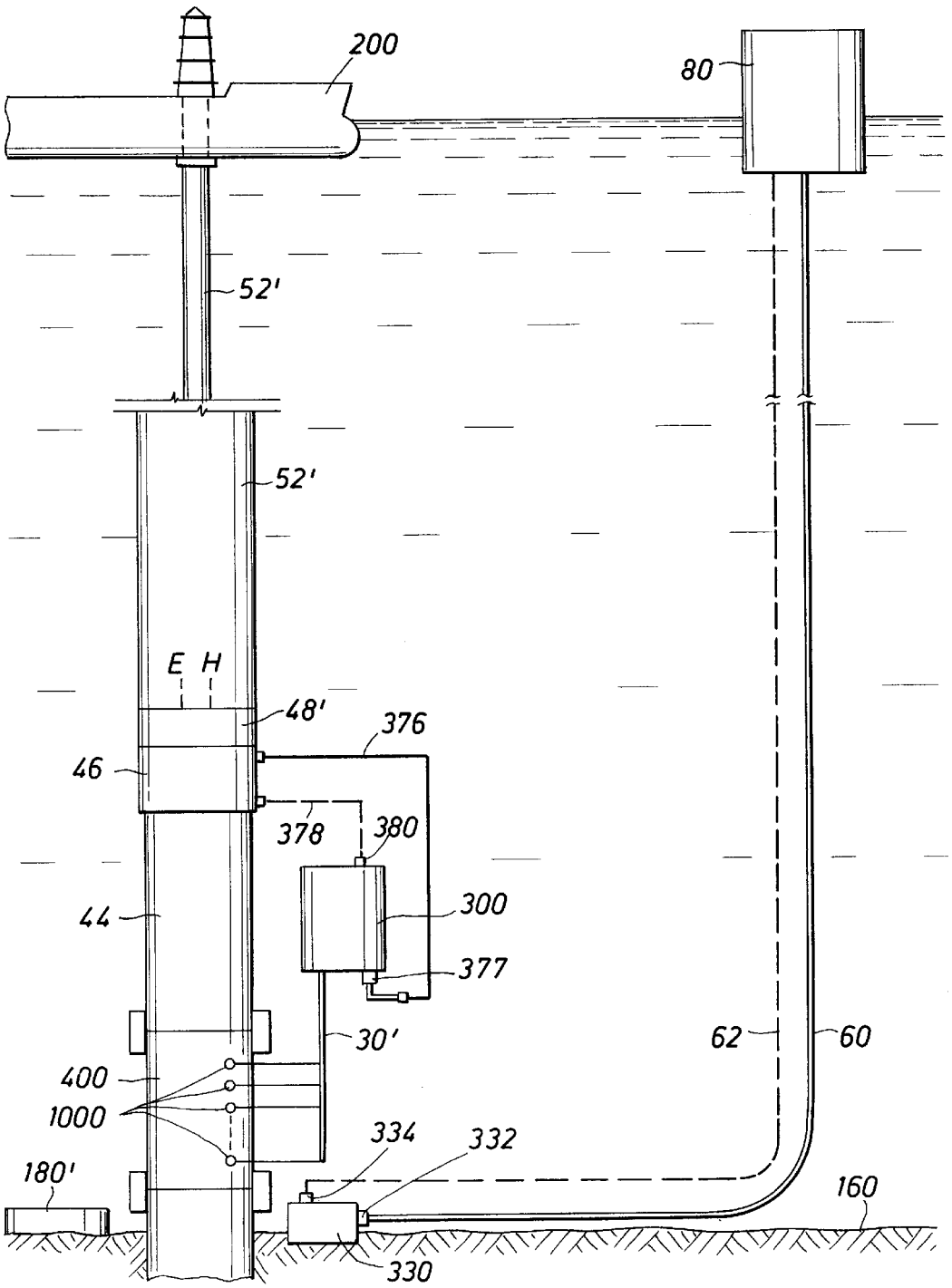

If the subsea tree is equipped with an electro-hydraulic control pod to operate the subsea tree in the production mode, it may be used during the well intervention mode as well. FIG. 3A shows that output lines from a tree control pod 300 are connected directly to valve actuators 1000 on tree 400 rather than to a tree cap U loop as shown in FIG. 1C. However to transfer control, the umbilical lines 60, 62' leading to the pod 300 from the remote facility must be disconnected and re-connected with control lines from the surface vessel. FIG. 3B shows the operations and arrangement. A completion riser 52' extends from vessel 200 to an Emergency Disconnect Package 48' and Lower Marine Riser Package 46 with a tree running tool 44 connected to the top of the tree 400 after tree cap 180' has been removed. Two flying lead connection operations are required: (1) a hydraulic supply umbilical 376 is made up to the subsea tree's umbilical hydraulic flying lead junction plate 377, and (2) an electrical cable umbilical 378 is connected to the pod 300 at the junction 380. The hydraulic 60 and electrical 62 umbilicals from host 80 are parked, by means of ROV operations to a seabed 160 parking module 330 at plates 332, 334. Now, the hydraulic supply during workover operations comes through a workover flying lead umbilical 376 connected to an umbilical H via riser 52' from the surface and workover electrical control signals come through an electrical flying lead 378 connected to an electrical umbilical E via riser 52'. The rig takes both electrical and hydraulic control over the tree as distinguished from the conventional method (as illustrated in FIG. 1D) of breaking only the hydraulic power source.

Figure 3C:
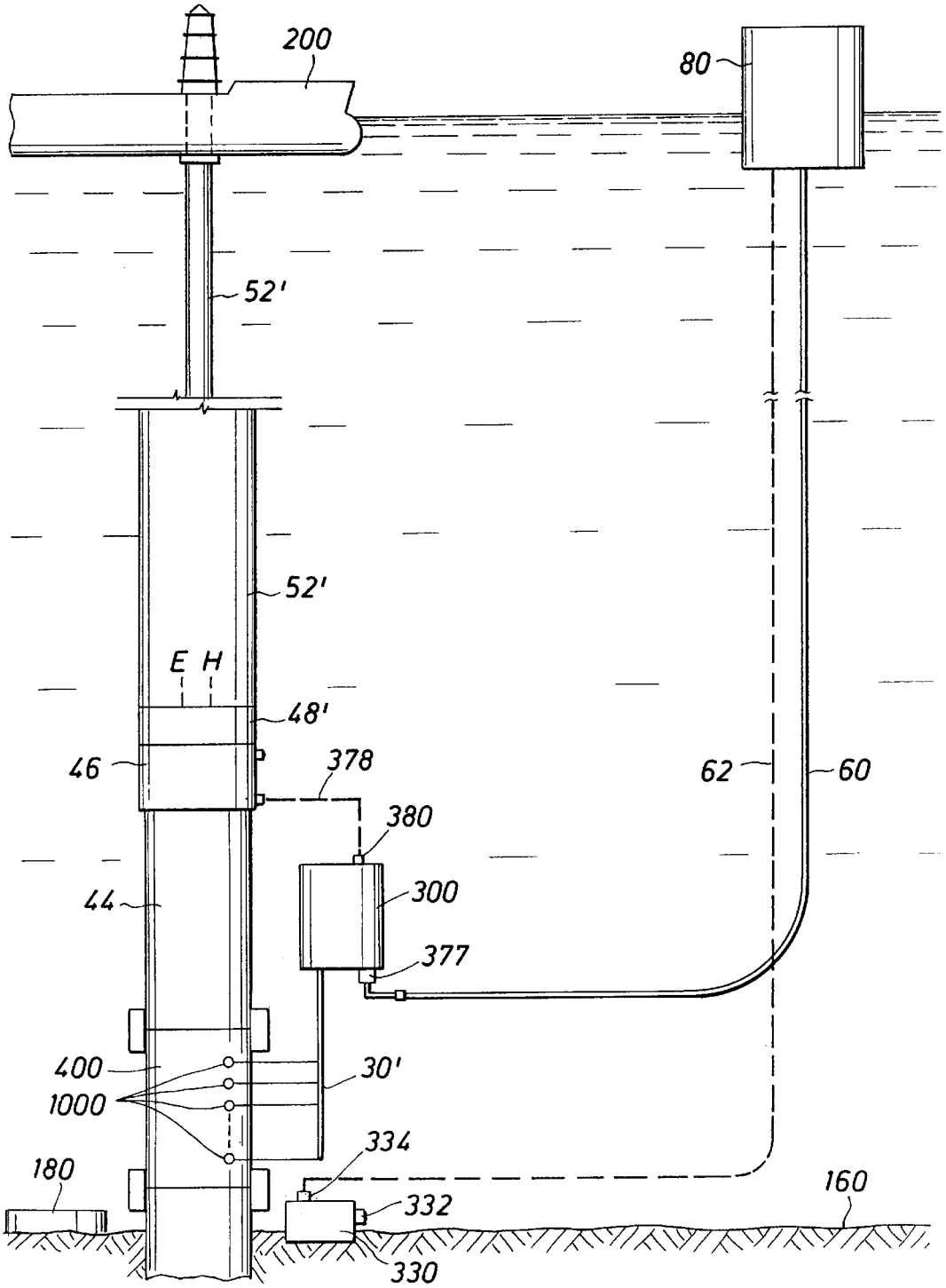

FIG. 3C shows a variation of the arrangement of FIG. 3B for workover operations.

If the hydraulic umbilical 60 is made-up to the tree 400, it can stay connected to the subsea tree 400 via pod 300 in order to provide hydraulic source of hydraulic pressure to power the tree's functions. The only connection changed is the electrical cable connection (as described by reference to FIG. 3B) to transfer the actual control of the pod (and the tree) to the surface vessel. This arrangement disturbs less hydraulic lines (connections, check valves, ports, etc.) thereby improving reliability and reducing connection times.

Benefits of the Arrangements of FIGS. 2A, 2B, and 3A, 3B, and 3C

The key features of the flying lead workover interface system embodiments described above are:

(1) Access to electrical feedback equipment (e.g., DHPT, SCRAMS and Tree P/T transducers) during installation/workover;

(2) Reduces stack-up height of tree by eliminating tree manifold;

(3) Reduces the number of hydraulic circuit tests during FAT/SIT and prior to offshore installation;

(4) No new technology required because flexible hose is available for up to 13 lines (limited to about 4000' water depth on 0 psi vented lines);

(5) Requires control pod to be function tested during workover;

(6) There are no "looped functions" left untested after installation;

(7) ROV must disconnect electrical and hydraulic flying leads from tree prior to retrieving completion riser; and (8) Requires disturbing the electrical flying lead connection on control pod during a wireline intervention as opposed to disturbing 36 hydraulic couplings.

The key benefits of the arrangements of the invention are:

(1) Reduces hardware costs.

(2) Increases functions of workover interface capacity.

(3) Improves reliability by providing:

(a) functioning control pod subsea prior to demobilizing;

(b) eliminates potential hydraulic leak paths; and (c) improves FAT/SIT and offshore testing time.

(4) Reduces rig time by eliminating drill pipe trip to install tree cap.

Detailed Description of Hydraulic Flying Lead Control

Figure 4A:
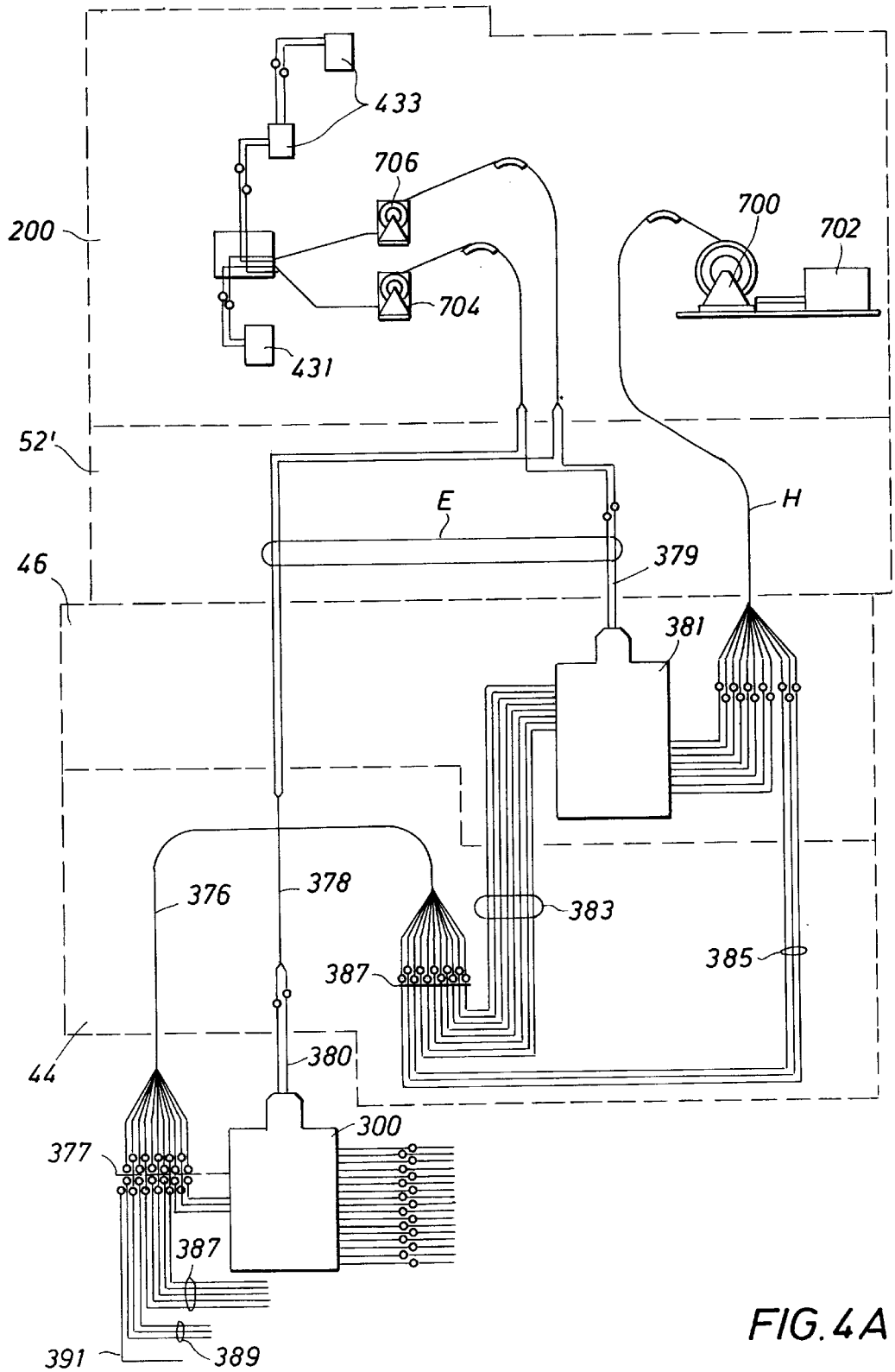
FIGS. 4A and 4B illustrate a preferred embodiment of a flying lead connection arrangement during workover operations.
Figure 4B:
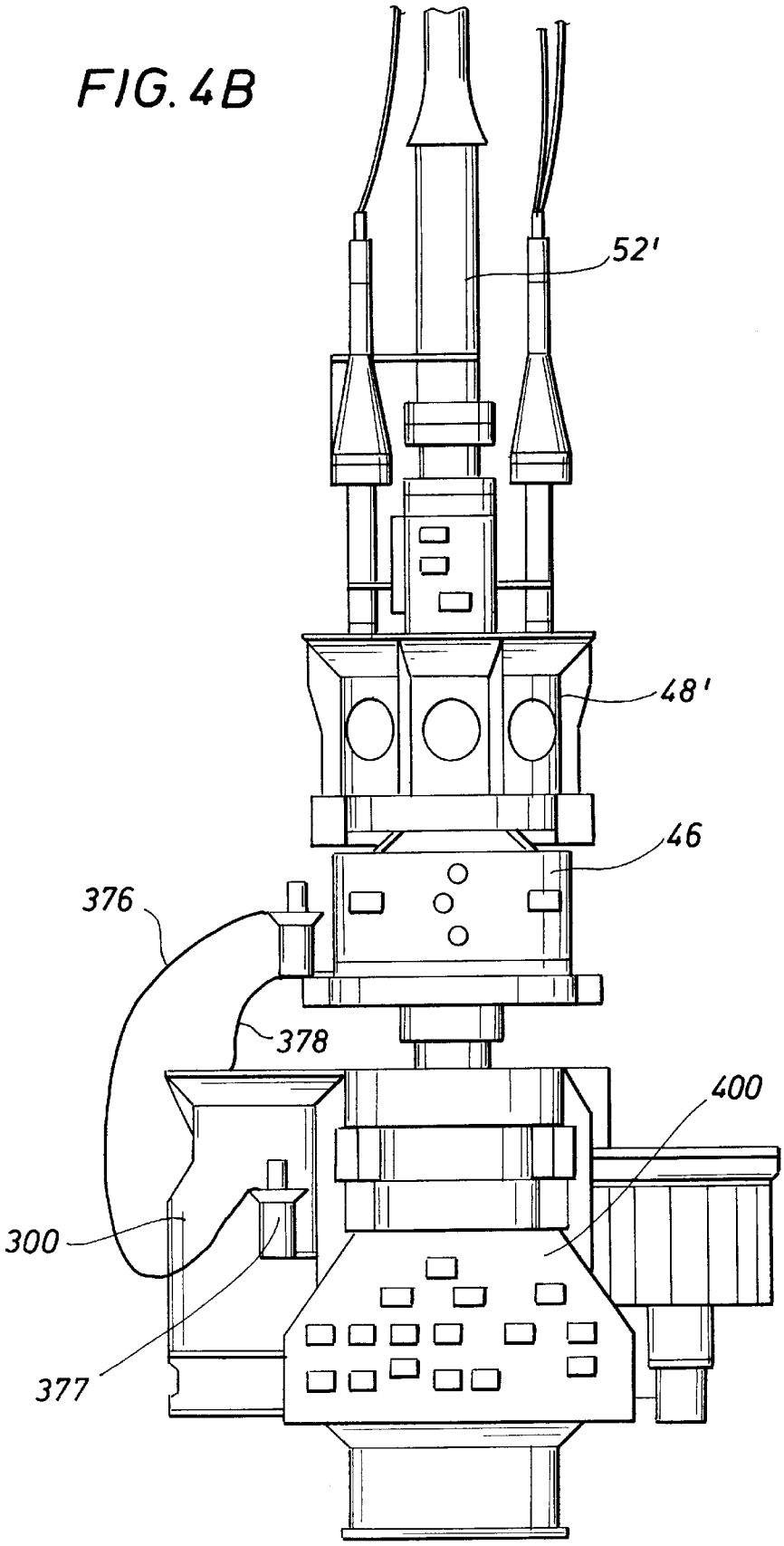

FIGS. 4A and 4B illustrate a preferred embodiment of the flying lead arrangement of FIG. 3B. At the vessel 200, electrical and hydraulic umbilicals E, H extend via riser 52' to Emergency Disconnect Package 46. At the vessel an umbilical hydraulic reel 700 spools hydraulic umbilical H to the riser 52'. A hydraulic power unit 702 supplies hydraulic power to each line in the umbilical H via connection at hydraulic reel 700. Two electrical cable reels 704, 706 spool electrical cable umbilicals to the riser 52'. The two electrical cable umbilicals, collectively labeled E, have two branches, one being the electrical flying lead 378 corresponding to the illustration of FIGS. 3B, 3C, and a second designated by reference numeral 379 to a riser control pod 381. A control station 431 and workover control station 433 are placed at vessel 200 for providing control signals to electrical umbilicals 378, 379.

The riser control pod 381, placed in the Emergency Disconnect Package 46, is a control station where certain hydraulic lines of hydraulic lines H are controlled by electrical actuators by means of control signals of electrical leads 379. The output hydraulic leads 383 from control pod 381 and other non-controlled leads 385 are combined at connector 387 to produce the hydraulic flying lead 376 of FIG. 3B. The electrical flying lead 378 is connected to plate 380 of control pod 300 during the workover mode. The hydraulic flying lead 376 is connected to plate 377 of the tree control pod 300 during workover operations. The tree control pod 300 controls hydraulic signals by means of electrically controlled actuators via electrical leads 378 while other leads 387, 389, 391 from plate 377 of the tree control pod are provided for tree workover function, chemical supply and annulus service.

FIG. 4B is an elevational view of a subsea tree 400 with a tree control pod 300. Plate 377 provides a connection port by which a ROV can attach hydraulic umbilical 376 to tree control pod 300.

Flying Lead Workover Control for Horizontal Trees

The description above specifies an arrangement and method for controlling a conventional, that is a vertical Christmas tree, for deep water wells during changeover from production to workover operations. A description of flying lead control according to the invention of a horizontal tree is presented below.

Workover Control System (WOCS) Interface

Figure 5:
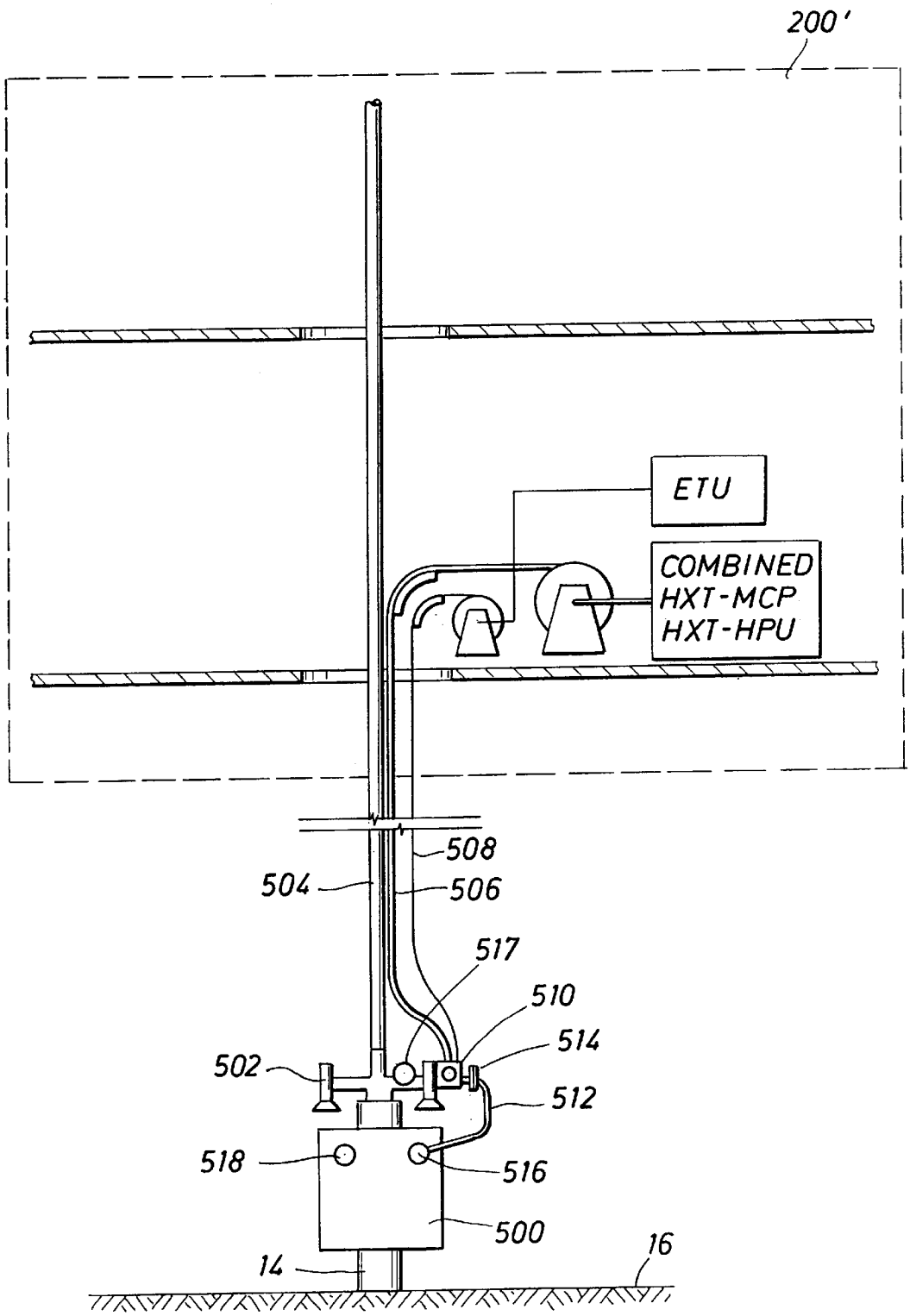
FIGS. 5, 6, and 7 illustrate flying lead arrangements for a horizontal christmas tree during installation, production and workover modes.
Figure 6:
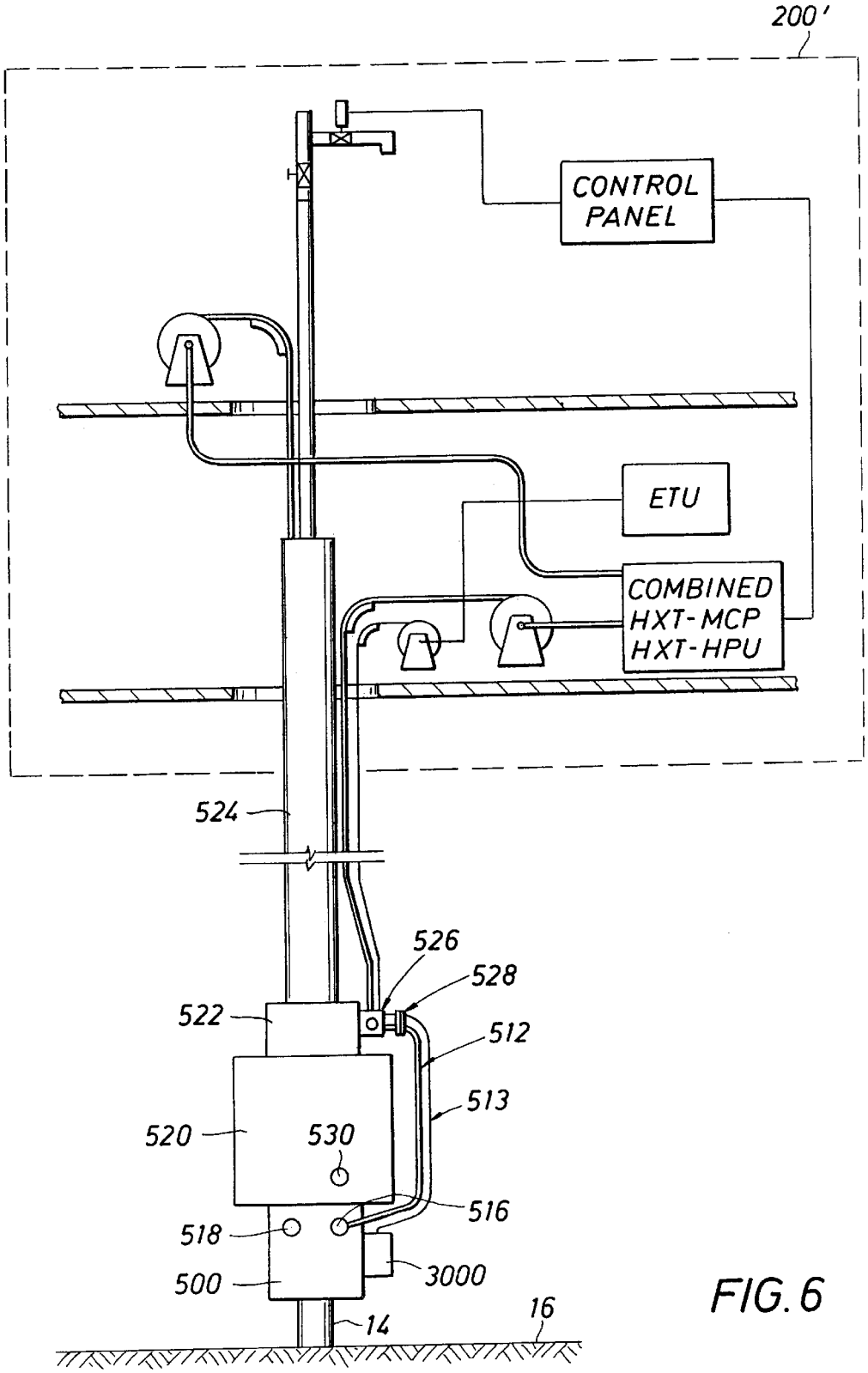
Figure 7:
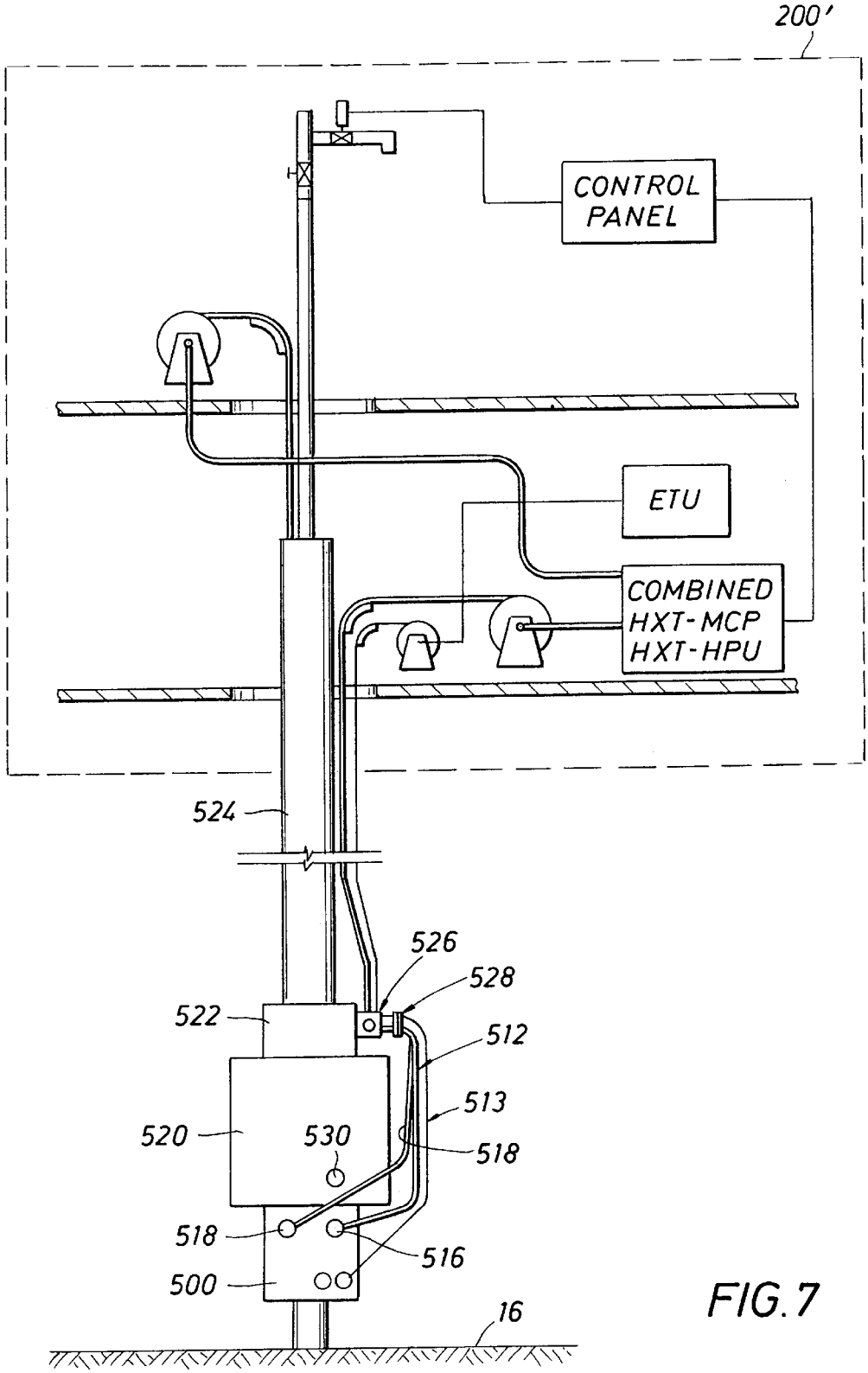

A workover control system (WCOS) that is configured to correspond with either electro-hydraulic (E/H) or direct hydraulic control options is illustrated in FIGS. 5, 6, and 7. The WOCS configuration for installing the tree body is shown in FIG. 5. This configuration is appropriate for both direct and E/H controlled tree options. In FIG. 5, a horizontal christmas tree (HXT) 500 is connected to a wellhead 14 at the seabed 16. A horizontal christmas tree running tool 502 secured to drill pipe 504 runs the horizontal christmas tree 500 to wellhead 14. Hydraulic 506 and electrical 508 umbilicals run from vessel 200' to a junction box and electrical parking module 510. During installation of the horizontal christmas tree 500, a hydraulic flying lead 512 runs from junction box 510, via umbilical shear plate 514 to the WOCS Module Quick Connect (MQC) 516 of the horizontal christmas tree 500. A production plug receptacle, PROD MQC 518 is also provided on the horizontal christmas tree 500. A parking plug 517 may also be provided on running tool 502.

During the tubing hanging and well completion work (that is, workover operation) (when BOP is attached) a ROV flying lead approach is used, as depicted in FIGS. 6 and 7, respectively. The difference between the arrangements of FIGS. 5 and 6 depends on whether or not the subsea control pod (SCM) 3000 of FIG. 6 is present.

Prior horizontal tree arrangements used divers to connect workover umbilical or stab plates mounted to the BOP's modified frame to effect the needed control of valves and functions on the tree. This cumbersome approach had to take the place of completion risers and umbilical connections which easily accessed the top of a conventional tree for transfer of control from "production" to "workover" modes. Since a tree cap for horizontal tree can not be used for this crossover function, the above approach is taken.

By using ROV flying lead umbilical connections, the task of establishing workover umbilicals is improved and simplified. The BOP 520 does not have to be modified for field fit-up since the flying lead portion of the umbilical goes around the main body of the BOP as illustrated in FIGS. 6 and 7. The main umbilical section can be run with the BOP's LMRP 522 on marine riser 524 in the same way that BOP pod umbilicals are run. The flying lead portion is plugged into a special junction box 526 and laid out on the BOP in preparation for use subsea. The junction box 526 features the crossover hardware from the bundled umbilical to the flying lead lines 512, 513 and provides a shear plate assembly 528 which severs the flying lead lines in an emergency when the LMRP 522 is disconnected. (The severed flying lead can be recovered by the ROV and repaired/reattached to the recovered umbilical prior to rerunning the LMRP).

After the BOP 520 is landed and tested, the ROV is free to connect the workover flying leads 512, 513 to the tree's connection points (e.g., the workover control system Module Quick Connect (MQC) 116 for intervention operations. If the tree has been in production with a production umbilical attached, (e.g., as in FIG. 2A, for example) the ROV may disconnect the production umbilicals (e.g., connected to production plug receptacle, PROD MQC 518) and "park" them on a provided parking place 530 (e.g., on BOP 20) out of the way before connecting the workover flying leads.

Two workover intervention arrangements are provided in FIGS. 6 and 7. First the ROV connects a flying lead 512 to a stab plate labeled "WOCS" 516. This plate provides controls to the annulus workover valve (WOV or annulus intervention valve (AIV)), the tree connector functions, the tree connector test function, the tubing hanger/tree cap test functions, and other functions only need to be operated during an installation or workover.

For the E/H control option of FIG. 6 the WOCS flying lead interface also provides a high and low pressure supply to the control pod. Valves operated by the control pod during the production mode are also operated in the workover mode, but with an electrical flying lead 513 suspended from the surface. (The ROV parks the "production" electrical flying lead and plugs in the workover electrical flying lead.) A surface control computer is added to the suite of WOCS equipment on the surface to communicate with the pod and send commands and monitor data.

For the direct hydraulic control option of FIG. 7, the workover flying lead interface is split into two sets, one for the "WOCS" flying lead 512 interface, the second 518 to the "PROD" flying lead interface. Again the WOCA bundle operates the "workover only" functions, as mentioned above, and the "PROD" flying lead operates the rest of the tree. However, instead of parking an electrical lead to a pod, the ROV parks the hydraulic production flying lead and installs the second workover lead in its place for direct control via the surface units. If desired, an electrical flying lead may be attached to monitor pressure and temperature sensors on the tree via the electrical flying lead interfaces (again once the electrical production flying leads has been parked).

What is claimed is:

1. A subsea well arrangement for deep sea operations comprising, a christmas tree (400) having valves controlled by hydraulic actuators (1000), electro-hydraulic control pod (300) having hydraulic lines (30') extending from said control pod (300) directly to said hydraulic actuators (1000) on said christmas tree, said control pod (300) having an electric input junction (380) and a hydraulic input junction (377), a remote production platform (80) connected in a production mode to said hydraulic input junction (377) by means of a production hydraulic umbilical (60) and to said electric input junction (380) by means of an electric umbilical (62), and a workover riser arrangement connected in a workover mode between said christmas tree (400) and a workover vessel (200), said workover riser arrangement having electric (E) and hydraulic (H) umbilicals from said vessel which terminate in a flying lead hydraulic umbilical (376) and a flying lead electric umbilical (378) at said christmas tree (400), wherein, in a workover mode, said production hydraulic umbilical (60) and said production electric umbilical (62) are disconnected respectively from said hydraulic input junction (377) and said electric input junction (380), and said flying lead hydraulic umbilical (376) and said flying lead electric umbilical (378) are connected respectively to said hydraulic input junction (377) and said electric input junction (380).

2. A subsea well arrangement for deep water operations comprising, a christmas tree (400) having valves controlled by hydraulic actuators (1000), an electro-hydraulic control pod (300) having hydraulic lines (30') extending from said control pod (300) directly to said hydraulic actuators (1000) on said christmas tree, said control pod (300) having an electric input junction (380) and a hydraulic input junction (377), a remote production platform (80) connected in a production mode to said hydraulic input junction (377) by means of a production hydraulic umbilical (60) and to said electric input junction (380) by means of an electric umbilical (62), and a workover riser arrangement connected in a workover mode between said christmas tree (400) and a workover vessel (200), said workover riser arrangement having an electrical umbilical from said vessel (200) which terminates in a flying lead electric umbilical (378) at said christmas tree (400), wherein, in a workover mode, said production electric umbilical (62) is disconnected from said electric input junction (380) and said flying lead electric umbilical (378) is connected to said electric input junction (380).

3. A method for maintaining control of valves controlled by hydraulic actuators (1000) of a christmas tree (400) of a deep water subsea well between production operations and workover operations, said christmas tree having an electro-hydraulic control pod (300) having hydraulic lines (30') extending from said control pod (300) directly to said hydraulic actuators (1000) on said christmas tree, said control pod (300) having an electric input junction (380) and a hydraulic input junction (377), said method comprising the steps of, while in said production operations, connecting a production hydraulic umbilical (60) and an electric umbilical (62) between a remote production platform (80) and said hydraulic input junction (377) and said electric input junction (380) respectively, to change to said workover operations, connecting a workover riser arrangement (52') between said christmas tree (400) and a workover vessel (200), said workover riser arrangement having electric (E) and hydraulic (H) umbilicals from said vessel which terminate in a flying lead hydraulic umbilical (376) and a flying lead electric umbilical (378) at said christmas tree (400), disconnecting said production hydraulic umbilical (60) and said electric umbilical (62) from said hydraulic input junction (377) and said electric input junction (380), and connecting said flying lead hydraulic umbilical (376) and said flying lead electric umbilical (378) to said hydraulic input junction (377) and said electric input junction (38).

4. A method for maintaining control of valves controlled by hydraulic actuators (1000) of a christmas tree (400) of a deep water subsea well between production operations and workover operations, said christmas tree (400) having an electro-hydraulic control pod (300) having hydraulic lines (30') extending from said control pod (300) directly to said hydraulic actuators (1000) on said christmas tree, said control pod (300) having an electric input junction (380) and a hydraulic input junction (377), said method comprising the steps of, while in said production operations, connecting a production hydraulic umbilical (60) and an electric umbilical (62) between a remote production platform (80) and said hydraulic input junction (377) and said electric input junction (380) respectively, to change to said workover operations, connecting a workover riser arrangement (52') between said christmas tree (400) and a workover vessel (200), said workover riser arrangement (52') having an electric (E) umbilical from said vessel (200) which terminates in a flying lead umbilical (378) at said christmas tree (400), disconnecting said electric umbilical (62) from said electric input junction (380), and connecting said flying lead electric umbilical (378) to said electric input junction (380).

5. A control equipment arrangement for production and workover operations of a subsea well comprising, a horizontal christmas tree (500) having valves controlled by hydraulic actuators, said christmas tree (500) having a hydraulic umbilical connection to a hydraulic plug receptacle, a production arrangement including a production umbilical connected to said hydraulic plug receptacle for control of production operations of said well, and a workover arrangement where said production umbilical is disconnected from said hydraulic plug receptacle, and including a blowout preventer (520) attached to a top end of said horizontal christmas tree (500) via a workover riser arrangement (524) coupled between said blowout preventer (520) and a workover vessel (200') with a workover hydraulic umbilical (512) running from said workover vessel (200') via said marine riser arrangement (524) to said hydraulic plug receptacle independent of connection to said blowout preventer (520).

6. The arrangement of claim 5 wherein, said hydraulic plug receptacle includes a production hydraulic plug receptacle (518) and a workover hydraulic plug receptacle (516), and in said production arrangement, said production umbilical is connected to said production hydraulic plug receptacle (518) and in said workover arrangement, said workover hydraulic umbilical (512) is plugged into said workover hydraulic plug receptacle (516).

7. The arrangement of claim 5 wherein, said horizontal christmas tree (500) includes an electrical control pod (3000) for control of production valve hydraulic actuator, said arrangement further comprising a flying lead electrical workover umbilical (513) running from said workover vessel (200') to said control pod (3000) where a production electrical umbilical has been disconnected from said electrical control pod (3000).

8. The arrangement of claim 5 further comprising, a second flying lead hydraulic umbilical (518) running from said workover vessel (200') to said production hydraulic plug receptacle (518) for control of production valves during workover operations.

9. A method for maintaining control of valves controlled by hydraulic actuators of a horizontal christmas tree (500) of a subsea well between production operations and workover operations, said christmas tree (500) having a production hydraulic umbilical connection to a production hydraulic plug receptacle (518), said christmas tree (500) having a workover hydraulic plug receptacle (516), the method comprising the steps of, while in said production operations, connecting said production umbilical to said production plug receptacle (518), and to change to said workover operations, installing a blowout preventer (520) to said horizontal christmas tree (500), connecting a workover riser arrangement between a workover vessel (200') and said blowout preventer (520), and disconnecting said production umbilical from said production hydraulic plug receptacle (518), and running a workover hydraulic umbilical (512) from said workover vessel (200') to said workover hydraulic plug receptacle (516) independent of said blowout preventer (520).

10. The method of claim 9 wherein, said horizontal christmas tree (500) includes an electrical control pod (3000) for control of said hydraulic actuators, said method further comprising the steps of, disconnecting a production electrical umbilical from said electrical control pod (3000), and running a flying lead electrical umbilical (513) from said workover vessel (200') to said electrical control pod (3000) independent of said blowout preventer, and connecting said flying lead electrical umbilical (513) to said electrical control pod (3000).

11. The method of claim 9 further comprising, the step of parking a disconnected end of said production umbilical to a parking place (530) out of the way before connecting said workover hydraulic umbilical (512) to said workover hydraulic plug receptacle (516).

12. A control equipment arrangement for production and workover operations of a subsea well comprising, a horizontal christmas tree (500) having valves controlled by hydraulic actuators which are controlled by an electrical control mechanism of a subsea control pod (3000), a hydraulic umbilical including hydraulic lines connected to hydraulic ports on said horizontal christmas tree (500), a production arrangement including a production electrical flying lead connected to said subsea control pod (3000) during production operations for controlling production valves in said horizontal christmas tree (500), and a workover arrangement including a workover electrical flying lead (513) running from a workover vessel (200') to said horizontal christmas tree (500) during workover operations for controlling said production valves in said horizontal christmas tree (500).

13. The arrangement of claim 12 further comprising, a hydraulic flying lead (512) umbilical running from said workover vessel to said horizontal christmas tree for providing hydraulic power during workover operations of said horizontal christmas tree (500).

* * * * *